United States Patent [19]

Bous

[11] 3,938,306

[45] Feb. 17, 1976

[54] SPINNING AND WINDING OF YARNS

[76] Inventor: Karl Bous, Sternstr. 74, 56 Wuppertal 2, Germany

[22] Filed: Aug. 20, 1973

[21] Appl. No.: 390,165

[30] Foreign Application Priority Data

Aug. 26, 1972 Germany ..... 2242151

[52] U.S. Cl. ..... 57/34 R; 28/59; 57/58.89; 57/91; 242/35.6 R

[51] Int. Cl.[2] ..... D01H 15/00

[58] Field of Search ..... 57/34 R, 34 HS, 58.89, 57/58.95, 91, 156, 157 MS, 32, 35; 242/35.6 R, 18 R; 28/59, 72.14, 76 R

[56] References Cited

UNITED STATES PATENTS

| | | | |
|---|---|---|---|
| 2,407,926 | 9/1946 | Hamilton | 57/32 X |
| 3,166,820 | 1/1965 | Taul et al. | 28/76 R X |
| 3,478,504 | 11/1969 | Ninitz et al. | 57/34 R |
| 3,603,518 | 9/1971 | Cochran, Jr. et al. | 242/35.6 R |
| 3,640,440 | 2/1972 | Sedlavik et al. | 242/35.6 R |
| 3,749,327 | 7/1973 | Roethke et al. | 57/34 R X |
| 3,751,778 | 8/1973 | Grosjean et al. | 28/72.14 |

*Primary Examiner*—Richard C. Queisser
*Assistant Examiner*—Charles Gorenstein
*Attorney, Agent, or Firm*—Neuman, Williams, Anderson & Olson

[57] ABSTRACT

A method and apparatus for continuously spinning and winding yarn are provided in enabling a stored length of spun yarn stored in a stacked and layered form in the course of traveling from the spinning point to the winding point to have yarn removed therefrom, without interrupting the spinning process, not only in the normal direction of yarn travel but also temporarily in the opposite direction.

13 Claims, 3 Drawing Figures

SPINNING AND WINDING OF YARNS

The invention relates to a method and a device for continuously spinning and subsequently winding yarns, in particular staple fibre yarn, upon open-end or so-called OE spinning machines.

In known OE spinning, the yarn is wound on to cylindrical cross-coils, as is necessitates by the constant spinning speed. However, this is unfavourable to the further treatment of the yarn during knitting or weaving and requires a further rewinding process, in which the yarn can possibly be cleaned at the same time. Furthermore, in OE spinning machines, the manual removal of breaks in the thread is difficult, these breaks occurring comparatively frequently, particularly in the production of fine yarns. The removal of breaks in the thread takes up much time and reduces both the efficiency and the productivity of this otherwise very rational spinning method. It is true that the known use of a yarn section, which is guided by a guide pin and is led back to the spinning turbine upon breakage of a thread, has led to a semi-automatic removal of the thread break, and has thus simplified operation of OE spinning machines. However, this does not always succeed in joining the end of the yarn to the fibres in the spinning turbine. Since, with the known machines, only one attempt at joining can take place at a time, if the thread break does not join successfully it must be removed by the spinner by hand.

The invention is based on the problem of providing a method and a device for continuously spinning and subsequently winding (spooling) yarns, in particular staple fibre yarn, on OE spinning machines, which do not have the above-mentioned defects. This is achieved in accordance with the invention basically in that the yarn which has been spun is stored on its way from the spinning point to the winding point in a large length of up to 100 meters and more in a heaped and layered form, and can be removed from the thus-formed yarn store, without interrupting the spinning process, not only in the normal direction of movement of the yarn but at times also in the opposite direction. This storage of the spun yarn in a comparatively large length is an essential condition in order for the yarn coming from the spinning point to be wound directly in a conical criss-cross wound form, according to a further feature of the invention, after passing through the yarn store. A further possibility given by the storage of the spun yarn in accordance with the invention lies in the fact that the yarn may be tested for faults before winding and has these removed by knotting them out. Furthermore, when there is a break in the thread, the yarn can be fed back to the spinning point so that its free end can be joined on, and so can be fed back to the spinning point many times for further attempts to join it, if the first attempt is unsuccessful. In this way, breaks in the thread can be removed with great safety without having to return to manual operation by the spinner. Finally, the yarn can be subjected to special chemical and/or thermal refining treatments during its storage.

In order to carry out the method described in accordance with the device, the invention has at least one spinning point, in particular in the form of an OE spinning turbine, and a subsequently-connected winding point for the spun yarn, whereby in accordance with the invention, a yarn storage chamber provided with a connected supply system and a control device controlling its state of filling and governing it by regulating the speed of yarn removal, are arranged between the spinning and winding points.

Further features and advantages according to the invention are described by means of several embodiments illustrated in the accompanying drawings, wherein.

Figure 1:
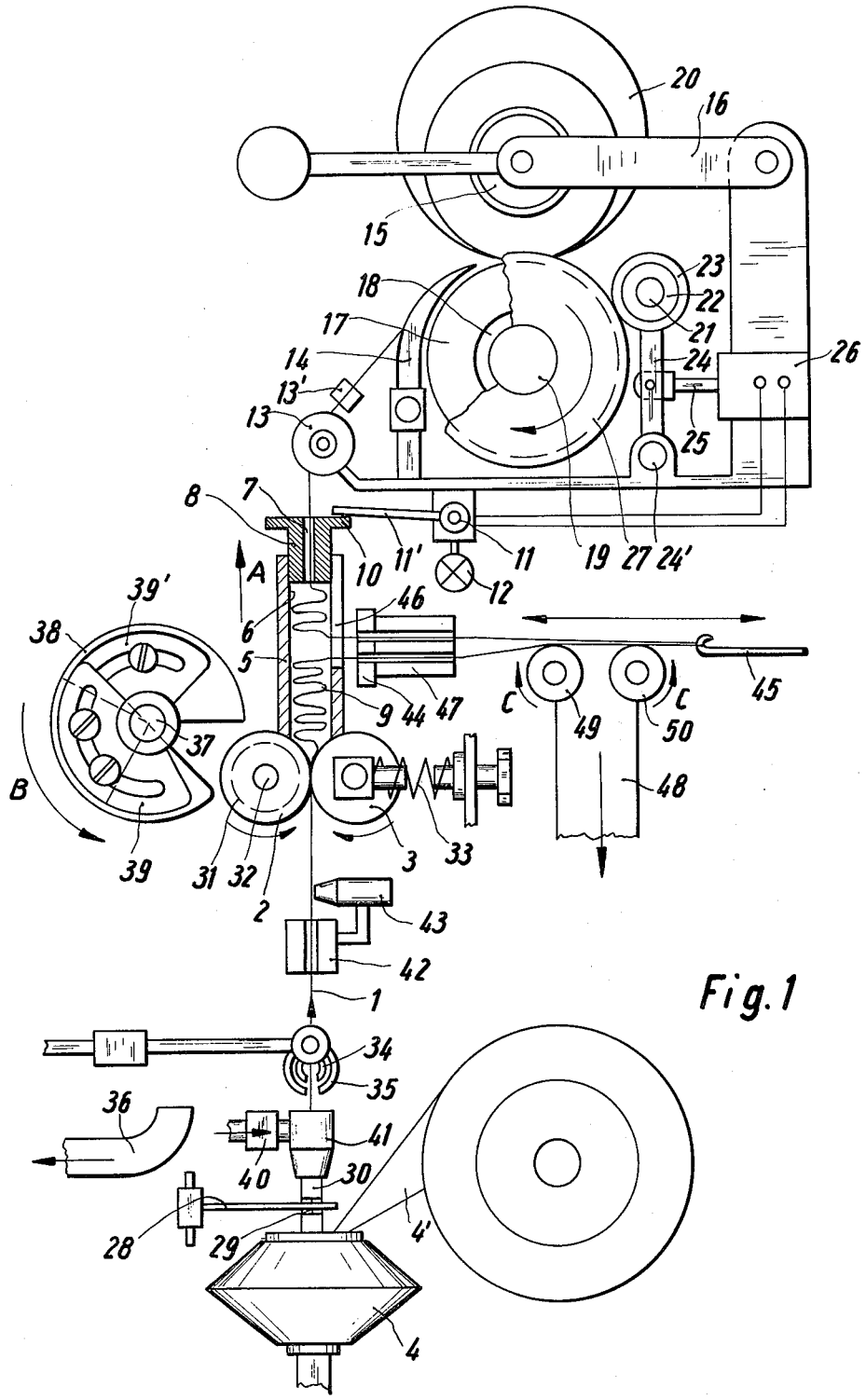
FIG. 1 shows a side view of an OE spinning point with a yarn storer and a winding point for producing conical crosscoils.

In the device illustrated in FIG. 1, the yarn 1 is removed by the rollers 2 and 3 of a suitably formed supply system from the spinning rotor 4 of an OE spinning machine with constant speed corresponding to the predetermined twist, and is stored in the desired amount in a chamber 5, which is closely connected with the rollers 2 and 3 and has a cross-section which can be round or rectangular. A plunger or piston 8 rests on the stored yarn and is guided by the walls 6 of the chamber 5 and provided with a yarn throughput opening 7. The piston 8 is pushed up by the stacked yarn 9 in the direction of the arrow A until the flange-like edge 10 at the upper control part of the piston 8 contacts a lever 11' for operating a valve or switch 11 and thus effecting illumination e.g. of a signal lamp 12. When the lamp 12 lights up, this is the sign for the spinner that the chamber 5 is filled with the desired amount of yarn. The spinner then pulls the end of the yarn from the storage chamber 5, e.g. with a wire hook, and guides it through a thread brake 13, a paraffin applicator device 13' arranged behind it and a chatoyant thread guide 14 to a conical winding sleeve 15 in a winding frame 16. The winding process then begins, namely by placing the sleeve 15 on the spool roller 17, which is driven by a shaft 19 through a free-running clutch 18. The yarn can now be removed from the storage chamber 5 with a lower or higher speed corresponding to the diameter of the conical sleeve 15 or of the cross-coil 20, independently of the speed of removal of the yarn from the spinning turbine 4, which is determined by the rollers 2 and 3.

Drive of the conical cross-coil 20 over the periphery of the spool roller 17, emphasised by yarn stress fluctuations and weight alterations of the coil 20, leads to slight differences in speed, which do not have an effect on the spinning speed but can lead to overfilling or emptying of the storage chamber 5. In order to avoid this, friction wheels 22 and 23 are provided and are rotatably connected to one another by being rotatably mounted on a pin 21; these wheels 22 and 23 are pressed (by means of a carrier arm 24, which is pivotable, about a hinge point 24', by means of a rod 25 connected e.g. to a compressed-air cylinder or an electromagnet 26) against a drive wheel 27 rotatably mounted on the shaft 19 and urged against the surface of the spool roller 17. The friction wheel 22 which has the smaller diameter then rests on the larger drive wheel 27 and the larger friction wheel 23 on the spool roller 17, which has a slightly smaller diameter than the drive wheel 27. The spool roller 17 is thus driven more quickly than its drive which would otherwise be through the free-running clutch 18 of the shaft 19.

According to the diameters of the drive transmission elements described, the yarn can be removed from the storage chamber 5 with a removal speed which is for example 3% to 20% higher until the edge 10 of the piston releases the lever 11' of the switch 11. Then the yarn is wound on to the spool 20 again at its normal spooling speed. This normal winding speed is a certain percentage lower than the spinning speed. In this way, the winding speed only needs to be regulated in one direction, namely towards higher speeds. In order to obtain the longest possible intervals between the two winding speeds and thus so as not to disturb the assembly of the spool, it is recommendable to keep the speed differences small.

The device described also has the great advantage that the yarn can be wound with greater or lesser yarn tension independently of the tension in the spinning section by suitable adjustment of the thread break 13, and this is very important for the further treatment of yarn e.g. dyeing.

As soon as the yarn 1 breaks in the section between the spinning turbine 4 and the removal rollers 2 and 3, e.g. because of a passing fault in the fibres in the spinning turbine or for other reasons, a yarn feeler 28, which advantageously contacts the yarn in a groove 29 in a tubular attachment 30 which is located on the spinning device, gives a signal to a yarn return device. This makes the supply roller 2, on which the supply roller 3 is pressed by a spring 33 and which is driven by a coupling 31 from the shaft 32, come out of engagement. Directly after this disengagement, the rollers 2 and 3 are rotated in the opposite direction, that is backwards, whereupon a section of yarn of a certain adjustable length is taken from the yarn supply 9 stacked up in the chamber 5 and is lead back to the spinning device. The yarn feeler 28 must then be brought out of the groove 29. It can only be released after completion of the process described in order to determine whether the attempt to join the fibres in the spinning turbine 4 to the re-fed end of the yarn has been successful. Should the joining attempt not have been successful, this can be repeated many times after removing and cutting off the yarn which has been introduced, e.g. by means of the device consisting of a cutter 34 and clamp 35 and/or by means of the yarn suction tube 36. Since in the meantime too great an amount of fibres may have collected in the spinning turbine 4, the fibres should be removed by a device which is not illustrated and/or the introduction of fibres into the spinning turbine 4 by the device 4' should be adjusted temporarily.

The yarn return device mentioned above consists of a drive device making exactly one revolution upon each thread break. On its spindle 37 are provided a de-coupling disc 38 for releasing the coupling or clugch member 31 illustrated in phantom lines in FIG. 1 connecting the roller 2 to the shaft 32 and furthermore a drive segment 39, whose circular length corresponds to the length of yarn leading back to the spinning turbine. It is more advantageous to provide two segments 39 and 39', however, which are adjustable relative to one another, instead of one segment 39, in order that, through reciprocal rotation on the spindle 37, the effective, i.e. the driving circular length and thus also the length of the yarn section to the fed back can easily be adjusted. A suitable amount of subdivision and adjustability is also recommended for the de-coupling disc 38.

When there is a break in the thread or when the joining attempt is repeated, the yarn return or its drive device receives an impulse from the yarn feeler 28 and begins to rotate in the direction of the arrow B. Firstly the disc 38 de-couples the roller 2 from the shaft 32 by moving coupling or clutch member 31 out of engagement with roller 2. Then the arcuate surfaces of the segments 39 and 39' press one after the other against the surface of the roller 2 and rotate it until the corresponding section of yarn is led back from the storage chamber 5 to the spinning turbine 4. Then the similarly adjustable de-coupling disc 38 releases the coupling 31 again so that the supply rollers 2 and 3 can again be driven by the shaft 32 and the yarn can in this way be fed into the chamber 5 at the given speed from the spinning turbine 4. The return device completes its revolution at 360°, whereupon it reaches its initial position again.

In order not to damage the yarn by the transmission of the rotational torque from the supply roller 2 to the supply roller 3, it is desirable to drive the roller 3 by means of gear wheels or the like, which are not illustrated, which engage within one another and are located on the shafts of the rollers. The gear wheel located on the shaft 32 can thus be used at the same time for the return drive of the roller 2 during the joining process if the segments 39, 39' have corresponding gear rims.

If, by arranging the parts required for the yarn return feed as described above, the distance between the spinning turbine 4 and the supply rollers 2 and 3 should become too great and also the sub-pressure in the spinning turbine 4 is insufficient to feed the yarn back through the tubular attachment 30 to the spinning turbine, a nozzle 41 supplied with compressed air can be provided upon the attachment 30 by way of an electromagnetic valve 40, so that the nozzle 41 can blow the yarn end back to the spinning turbine. This nozzle 41 can advantageously also be used for cleaning e.g. superfluous fibres away from the spinning turbine 4 before or between the joining attempts, for which purpose the nozzle 41 should be briefly supplied at a higher air pressure than is necessary to introduce the end of the yarn into the spinning turbine 4. Furthermore, the tubular attachment 30 can be moved into a position where it is close to the rollers 2 and 3, if, in addition to the yarn feeler 28, a cutter 34, a clamp 35 and a yarn fault sensor 42 and associated yarn fault marking device 43 of a knotting device which is still to be described are so constructed that these parts form with or in the attachment 30 a through-going channel for the yarn. In the latter case, the additional air supply from the nozzle 41 for returning the yarn end back into the spinning turbine 4 can be dispensed with, if desired.

Figure 3:
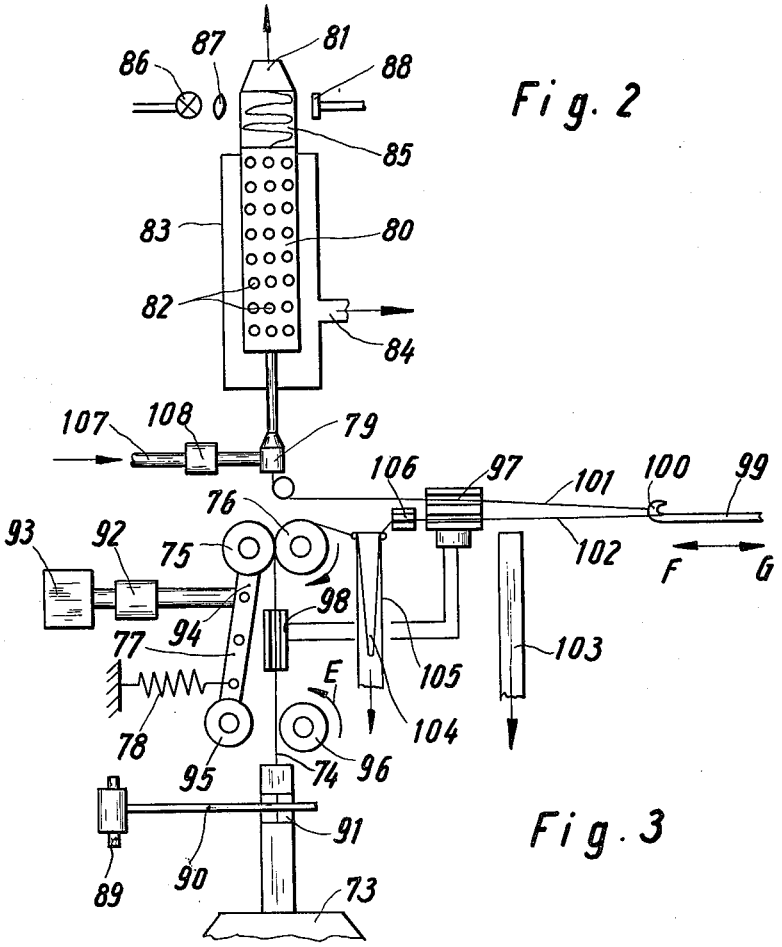
FIG. 3 shows an OE spinning point with a connected yarn storer for additional chemical and/or thermal treatment of the yarn.

When removing yarn breaks caused by foreign matter in the fibre silver supplied as well as by brief irregular supplies of fibres to the spinning machine, yarn faults can arise which upset further treatment of the yarn. These yarn faults must normally be removed in a subsequent rewinding process. However, the device according to FIG. 1 can additionally be provided with a yarn cleaning device, whereupon such additional rewinding processes for yarn cleaning can be dispensed with. This is carried out in the following manner:

When there is a yarn fault in the section between the spinning turbine 4 and the storage chamber 5, the e.g. electronically operating yarn fault sensor 42 sends an impulse to the making device 43, so that it can mark the faulty yarn point, e.g. with a dye which can be washed out or with a radioactive substance. As soon as the marked portion of the yarn passes a detector device 44 e.g. a photo cell or Geiger counter, through the pressure of the yarn reaching the storage chamber 5, the yarn fault is registered and a clamp 45 makes engagement. This moves through a slot 46 in the wall of the storage chamber 5 into the yarn container 9 to about the chamber centre, grasps one or more yarn loops with its hook-like point and upon its return movement pulls these loops through a knotter 47 and past the mouth of the suction pipe 48. Since further yarn loops can be found between the storage chamber 5 and the suction pipe 48 besides the faulty yarn point, removal rollers 49 and 50 which are movably mounted at the suction pipe inlet and pressed against one another and are rotated in the directions of arrows C so that about 3 to 6 meters of yarn are additionally removed from the chamber 5. Yarn removal rollers similar to rollers 49 and 50 are known in the art, as seen in FIG. 3 of Nimitz et al. U.S. Pat. No. 3,478,504. This ensures that the yarn fault can thus be grasped and the two ends of the yarn can become correctly located in the knotter 47. The knotter 47 is now actuated by a device which is not illustrated. The cut yarn ends are transported by the suction tube 48 to the refuse container, while the yarn loop projecting from the slot 46 with the knot is led by the meandering movement of the yarn supply 9 into the chamber 5 in the direction toward its piston 8 until it comes out of the chamber through the opening 7 and is finally would.

Since the spinning speed is comparatively low and yarn faults do not arise very frequently, according to a further embodiment, the knotting device, consisting of the knotter 47, the clamp 45 and the suction pipe 48 together with the removal rollers 49 and 50, can be arranged to be movable and can operate at any one of several spinning points, while the knotting device which is controlled by the detector device 44 knots out the yarn faults of several spinning points.

Figure 2:
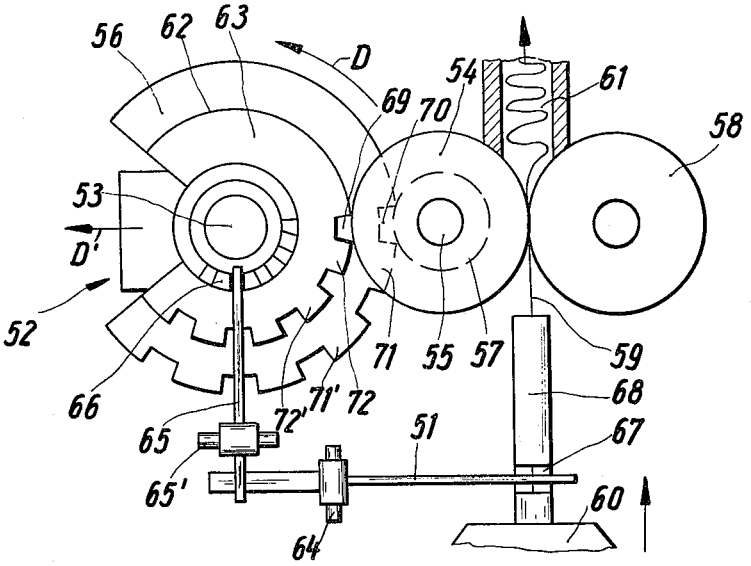
FIg. 2 shows an intermittently-operating joining device.

In FIG. 2 a yarn joining device is illustrated which upon breakage of a thread first leads a section of the yarn of a certain length back to the spinning device and, if the joining attempt is unsuccessful, then intermittently feeds yarn back in sections from the storage chamber to the spinning device, contacts it and leads a new yarn section into the spinning device until the joining attempt has been successful. The following takes place:

Upon breakage of a thread, a yarn feeler 51 which is pivotable about an axis 64 sends a signal to a rotary device 52, whereby its shaft 53 begins to rotate through 360° in the direction of an arrow D. As already described in relation to FIG. 1, rotation of a roller 54 by means of a shaft 55 (equivalent to the roller 2 and shaft 32 of FIG. 1) is interrupted so that a decoupling segment 56 mounted on the shaft 53 disengages a coupling 57, whereupon the roller 54 and its associated roller 58 (equivalent to the roller 3 of FIG. 1) can reverse so as to cause removal of the yarn 59 normally being fed from a spinning turbine 60 to a storage chamber 61. At the same time or shortly afterwards, the arcuate surface 62 of a gear segment 63 which is similarly driven by the shaft 53 begins to rotate the removal rollers 54 and 58 in the opposite direction until the length of yarn which is determined by the correspondingly chosen length of the arcuate surface 62 has returned to the spinning turbine 60. In order not to prevent this process, the yarn feeler 51 is then pivoted out of its access slot 67 in the spinning turbine connection tube 68, by means of a two-armed lever 65 which is pivotable about an axis 65' by means of a cam disc 66 which is also driven by the shaft 53.

As soon as the first tooth-gap or recess 69 in the gear segment 63 and the similar first recess 70 in the de-coupling segment 56 reach the positions shown in FIG. 2, the shaft 55 again drives the roller 54 in the normal working direction via the coupling 57 and the yarn feeler 51 is released by the cam disc 66 in order to be able to contact the yarn 59 once more in the spinning turbine connection tube 68.

If the joining attempt is successful, further pivotal movement of the yarn feeler 51 into the slot 67 is prevented by the yarn tension and the rotary device 52 is moved away in the direction of arrow D' by means of a signal from the yarn feeler, whereupon the device completes its revolution through 360° without preventing the spinning process and thus returns to its initial position. However, if the joining attempt has not been successful, the coupling 57 is disengaged again by means of the subsequent cam segment 71 of the de-coupling disc 56 and, after the yarn feeler 51 has been pivoted out from the slot 67 in the tube 68 by the cam disc 66, the arcuate section 72 of the gear segment 63 feeds a further portion of yarn back to the spinning turbine 60. The yarn feeler 51 then determines whether this time the joining attempt has been successful. The joining attempt can be repeated several times, depending upon the remaining number of subsequent arcuate sections 71', 72'.

If the yarn has still not been joined after completion of the 360° revolution of the rotary device 52, the spinning point is stopped by a device which is not illustrated and this condition is signalled to the spinner, e.g. by a lamp whereupon he removes the fault by hand.

With a device like that of FIG. 2, a longer than necessary portion of yarn is first brought back to the spinning turbine 60 and this yarn portion is then intermittently drawn out of the spinning turbine in sections until a join has been made. The reverse is also possible, in that the yarn end which is to be brought back to the spinning turbine 60 is made increasingly longer, that is it penetrates deeper into the turbine 60. All this can easily be achieved by suitable co-ordination between the normal advance speed of the supply rollers 54, 58 and their return speed governed by the correspondingly adjusted rotary device 52.

In FIG. 3, a further embodiment of a yarn storage chamber 80 is illustrated, which is arranged between a spinning point and a winding point, which, apart from the winding of yarn on to conical cross-coils and the removal of yarn faults, also allows treatment of the yarn with a suitable treatment agent to take place during the spinning and winding process. The yarn 74 coming from a spinning turbine 73 is fed by removal rollers 75 and 76 into a yarn storage chamber 80 which is provided with a nozzle 79. The removal roller 76 is driven at the given speed, whereas the roller 75 is carried by a two-armed lever 77 and is pushed against the roller 76 by the force of a tension spring 78. The conveying or treatment agent e.g. compressed air, steam and/or a steam-water mixture, at a pressure of 0.04 to 1 atmosphere, flows into the storage chamber 80 through the nozzle 79. The yarn 74 is transported by the suction of the nozzle 79 with slight thread tension into the storage chamber 80, in which it piles up in layers in loop and/or spiral form. It is then pressed together lightly by the pressure of the medium flowing into the chamber 80 and is fed to the chamber outlet 81. The treatment fluid can thus flow out through openings 82 in the wall of the storage chamber 80 and may also be led off or suctioned off from a tubular jacket 83 surrounding the chamber, by means of an outlet pipe 84. Since the yarn which is being removed from the spinning turbine at constant speed can be stored in the chamber 80 in a length of e.g. 20 to 300 m, it remains in this chamber for a period of 20 sec to 5 min, at a spinning speed of 60 m/min, so that it can be removed at an irregular speed, as takes place e.g. when winding it on conical cross-coils, and/or during this remaining period it can be thermally treated, stabilised and/or pre-shrunk by the effect of the heated treatment agent.

The following measures are provided in order to prevent overfilling or emptying of the storage chamber 80 when there is irregularity in removing the yarn from it:

The end portion 85 of the chamber 80 is made of transparent material, e.g. glass or plexiglass. A photoelectric control device consisting of a light source 86 and a condenser lens 87 on one side of the end portion 85 and a receptor photocell 88 on the other side gives a signal to an associated yarn winding device, which is not illustrated in FIG. 3, so as to cause increase in the winding speed as soon as the beam of light which normally traverses the transparent end portion 85 is interrupted or at least sufficiently weakened by the yarn stored in the chamber 80. The chamber 80 begins to empty more quickly, especially because of the higher speed of removal. The light beam from the source 86 then reaches the photo-cell 88 again and the yarn can be removed from the chamber 80 at the lower speed previously used. With this means of regulation of the filling of the chamber, the speed of introduction of the yarn must be higher than the speed of removal of yarn, so that the stored yarn can always interrupt the light beam and constant filling of the chamber can be ensured. With appropriate operation of the photoelectric control device, it is also of course possible to remove the yarn from the chamber at a higher speed than it is introduced and, as soon as the path for the light beam is free, it is possible to stop the winding point or to lift the spool from its roller until the light beam is again interrupted by the stored yarn.

When the thread breaks, a yarn feeler 90 pivotally mounted about an axis 89 penetrates deeper into the slot 91 in the associated spinning device pipe, whereupon an electromagnet 92 pulls the upper arm 94 of the two-armed lever 77 for a duration of time which is determined by a timer relay 93 and thus releases the yarn from its clamping point between the removal rollers 75 and 76. At the same time, however, a roller 95 on the other end of the lever 77 is pushed against a driven roller 96 which is rotating in the direction of the arrow E, whereby a yarn section whose length is determined by the timer relay 93 is fed back to the spinning turbine 73. The fibre ring located in the spinning turbine turns on the end of the yarn. After the time which has been set on the relay 93 has expired, the supply of current to the electromagnet 92 is interrupted, whereby the tension spring 78 pivots the lever 77 back and thus the removal roller 75 again presses against the roller 76. The spinning process continues further if the yarn feeler 90, which is pivoted out of the slot 91 during joining, is prevented by the yarn tension from penetrating further into the spinning turbine pipe.

Should a join not have been made, the yarn feeler 90 penetrates deeper into the slot 91, since there is no yarn tension. This then initiates a further joining attempt. Should the break in the thread not have been removed on the second or third attempt, the spinning point is stopped by a device which is not illustrated and the fault is removed by the spinner.

Even with the device of FIG. 3, when using a controlled timer relay, it is possible to lead back a yarn section of a certain basic length into the spinning device and then to supply to the spinning turbine and/or to remove from it shorter or even longer lengths of yarn intermittently.

Because of impurities, accumulation of fibres for a short time or other disturbances, which occur, e.g., when joining, faults occur from time to time in the yarn, which can also be removed with the device of FIG. 3, without the spinning process having to be interrupted. The main parts of the yarn cleaning device are a knotter 97 and a yarn fault recorder 98, generally analogous to the knotter 47 and device 42 of FIG. 1. As soon as a faulty section of yarn passes the recorder 98, this fault is recorded and is transmitted in accordance with the spinning speed to a device which is not illustrated, with a delay of about 1/10 sec., and this device moves a thread clamp 99 in the direction of the arrow F through the knotter 97 to the yarn portion located between the removal rollers 75 and 76 and the nozzle 79, so that the clamp hook 100 grasps the yarn and leads it back via the knotter 97 in the reverse direction of the arrow G. A loop is thus produced in the yarn, the two ends 101, 102 of which are laid in the guide grooves of the knotter 97. The yarn loop is thus formed partially from the yarn coming from the spinning turbine and partially from the yarn which has already piled up in the storage chamber.

Care must be taken that, through proper co-ordination of the delay of the e.g. electronically-operating yarn fault recorder 98, the spinning speed and the movement of the clamp 99, the yarn fault comes to rest behind the knotter 97 and that after forming the knot, the yarn fault together with the cut ends is taken to the refuse container by way of the suction pipe 103. However, since a yarn loop forms between the removal rollers 75 and 76 and the knotter 97 during the knotting process, because the spinning process has not been interrupted, it is preferable to store the yarn temporarily as a loop 104 in a separate suction tube 105. Advantageously, between the yarn loop 104 and the knotter 97, another clamping point 106 is provided, which clamps the yarn firmly during the knotting process. The yarn loop consisting of the ends 101 and 102 which is guided by the clamp hook 100 through the knotter 97, and which is tensioned by the suction of the nozzle 79, receives the tension which is necessary for knotting.

After completion of the knotting process, the knot is released by the ejection lever of the knotter 97, the clamping point 106 is opened and the sub-pressure in the suction tube 105 is relieved, so that the remaining cleaned yarn loop can be suitably supplied to the storage chamber 80 by way of the nozzle 79 at a higher speed than the spinning speed.

Apart from the thermal treatment in the storage chamber 80 already described, the yarn can also be e.g. conditioned, finished, reserved, coloured and otherwise treated by a suitable supply of treatment agent with various auxiliary agents during spinning, which agent flows under pressure into the storage chamber. For this purpose, a mixing and metering device 108 connected in an inlet pipe 107 to the nozzle 79 is used, which device 108 distributes the corresponding auxiliary agent regularly into the fluid pressure medium.

The use of the method and device described is not limited to the OE spinning method, but can also be used in other known spinning methods or those still being developed. It is thus possible to use the devices advantageously even on braiding machines, in which continuous threads are spun with fibres. Use on twisting machines and other textile machines is also possible.

What I claim is:

1. An apparatus for continuously spinning and subsequently winding yarn which comprises at least one yarn-spinning means, yarn-winding means for receiving and winding the spun yarn, yarn storage means located between said spinning means and said winding means, means adapted to selectively feed yarn to and from said storage means, adjustable control means located between said spinning means and said winding means adapted to govern the rate of removal of yarn from said yarn storage means, means for detecting a fault in the yarn disposed in the path of said yarn passing from said yarn-spinning means to said storage means, yarn-marking means actuated by the fault-detecting means and located adjacent said yarn path and adapted to mark the yarn adjacent the detected fault, means sensitive to the mark made by said fault-detecting means disposed adjacent said yarn path, a yarn knotter and cooperating thread clamp actuated by the sensitive means upon sensing a mark made by said fault-detecting means, said knotter and clamp joining yarn portions adjacent the yarn portion containing said fault, and means for engaging and removing the yarn fault-containing portion from the joined yarn portions after actuation of said knotter and clamp.

2. An apparatus according to claim 1 in which the knotter and yarn fault-detecting means are arranged adjacent the yarn storage means which comprises a chamber having a longitudinal slot and a reciprocable hook-ended thread clamp passing through said slot into the supply of yarn located within said chamber.

3. An apparatus according to claim 2 in which a suction pipe is located below the path of movement of the clamp and has two oppositely-rotatable yarn removal rollers located for effecting removal of a predetermined length of yarn from said storage chamber.

4. An apparatus according to claim 1 in which the winding means includes a conical winding spool mounted in a pivotable frame having a winding roller arranged therebelow, wherein the winding roller is arranged to be driven at an adjustable speed and to be brought temporarily to rest, in dependence on the state of filling of the yarn storage means.

5. An apparatus according to claim 4, in combination with a drive shaft on which the winding roller is mounted, clutch means interposed said roller and shaft, and speed adjusting means sensitive to the quantity of yarn in said storage means for regulating the rotational speed of said winding roller by frictionally engaging the same.

6. An apparatus according to claim 5 in combination with an electromagnet having a control rod on which said speed adjusting means is mounted, a control piston displaceably mounted on the yarn exit end of the storage means and acted upon by the yarn supply in said storage means, said control rod being operable in accordance with the position of said control piston whereby said brake means is sensitive to the position of said piston and the quantity of yarn in said storage means.

7. An apparatus according to claim 4 in which a thread brake and a paraffin applicator are arranged between the yarn storage means and the winding spool.

8. An apparatus according to claim 1 in which a blowing nozzle connected to an air-supply line is included in the path of movement of the yarn between the spinning means and the storage means.

9. An apparatus according to claim 1 in which a cutter, an associated clamp and a suction tube are included in the path of movement of the yarn, for cutting and removing the end of yarn after one or more unsuccessful yarn-joining steps.

10. An apparatus according to claim 1 in which a yarn supply nozzle is connected to the storage means and a suction tube for forming an additional yarn loop and an associated yarn clamp point are provided between the feed means and said yarn knotter.

11. An apparatus according to claim 10 in which the storage means comprises a perforated chamber and a blowing-medium source is connected to the yarn supply nozzle; a line connecting said nozzle and source includes a mixing and metering device for the additional introduction of one or more yarn treatment agents.

12. An apparatus according to claim 1 in which a photoelectric control device is arranged for regulating the degree of filling of the storage means which has a transparent end portion and for controlling the speed of yarn removal from said storage means, the control device having a path for a light beam which passes through the transparent end of the yarn storage means.

13. An apparatus according to claim 1 in which the yarn feeding means comprises a pair of counter-rotating rollers, one roller of said pair being arranged to be driven, a pivotable lever on which the other roller of said pair is carried for selective driving connection with said driven roller, means for selectively driving said driven roller, and a yarn feeler for controlling said driving means by means of a relay interposed said feeler and said driven roller.

* * * * *